US008277291B2

(12) United States Patent
Dovel

(10) Patent No.: US 8,277,291 B2
(45) Date of Patent: Oct. 2, 2012

(54) ABRASIVE SLOTTED DISC WITH CONTROLLED AXIAL DISPLACEMENT OF A WORKPIECE

(75) Inventor: Daniel T. Dovel, Shady Cove, OR (US)

(73) Assignee: Professional Tool Manufacturing, LLC, Ashland, OR (US)

( * ) Notice: Subject to any disclaimer, the term of this patent is extended or adjusted under 35 U.S.C. 154(b) by 1185 days.

(21) Appl. No.: 12/114,632

(22) Filed: May 2, 2008

(65) Prior Publication Data

US 2008/0274677 A1 Nov. 6, 2008

Related U.S. Application Data

(60) Provisional application No. 60/916,216, filed on May 4, 2007.

(51) Int. Cl.
*B24B 9/02* (2006.01)

(52) U.S. Cl. ..... 451/293; 451/45; 451/551

(58) Field of Classification Search ..... 76/82, 89.1, 76/89.2; 451/45, 259, 293, 527, 548, 551
See application file for complete search history.

(56) References Cited

U.S. PATENT DOCUMENTS

| | | | | |
|---|---|---|---|---|
| 6,290,582 | B1 * | 9/2001 | Eklund | 451/263 |
| D463,965 | S * | 10/2002 | Lee et al. | D8/70 |
| 6,814,657 | B2 * | 11/2004 | Spangenberg et al. | 451/548 |
| 7,198,558 | B2 * | 4/2007 | Levsen | 451/263 |
| D559,649 | S * | 1/2008 | Ahn | D8/70 |
| 7,364,502 | B2 * | 4/2008 | Ficai | 451/548 |
| 7,722,443 | B2 * | 5/2010 | Levsen | 451/262 |
| 2008/0214095 | A1 * | 9/2008 | Dovel et al. | 451/65 |

* cited by examiner

*Primary Examiner* — Timothy V Eley
(74) *Attorney, Agent, or Firm* — Hall Estill Attorneys at Law

(57) ABSTRACT

Apparatus and method for sharpening a workpiece, such as a cutting tool. An abrasive disc is rotatable about a disc rotational axis and includes a plurality of spaced apart, radially disposed apertures extending therethrough from a first surface to an opposing second surface of the disc. The first surface is configured to facilitate sharpening of a workpiece by contacting engagement of the workpiece against an abrasive layer adjacent the first surface between adjacent first and second apertures of said plurality. The first surface further induces controlled axial displacement of the workpiece away from the disc as the second aperture approaches the workpiece during disc rotation. The first surface is preferably concave so as to extend into the disc between each adjacent pair of the apertures. Alternatively, the first surface is provided with different compressibilities to induce the controlled axial displacement of the workpiece.

23 Claims, 6 Drawing Sheets

ABRASIVE SLOTTED DISC WITH CONTROLLED AXIAL DISPLACEMENT OF A WORKPIECE

RELATED APPLICATIONS

This application makes a claim of domestic priority under 35 U.S.C. §119(e) to U.S. Provisional Patent Application No. 60/916,216 filed May 4, 2007.

BACKGROUND

Workpieces such as cutting tools can be provided with one or more laterally extending cutting edges. Such cutting edges are useful, for example, in planing a surface such as a wooden board, cutting a brick or other member through the application of a sharp impulse to the tool opposite the cutting edge, removing material from a substrate such as in the case of a knife, carving tool, etc.

While such tools have found great popularity and utility in a variety of applications, one problem that often arises is that, after repeated use, the cutting edge can become dull and/or damaged. It is therefore often desirable to periodically sharpen the tool in an attempt to provide a uniform, sharp and well defined cutting edge for the tool.

SUMMARY

Various embodiments of the present invention are generally directed to an apparatus and method for sharpening a workpiece, such as a cutting tool.

In accordance with some embodiments, an abrasive disc is provided for rotation about a disc rotational axis. The disc includes a plurality of spaced apart, radially disposed apertures extending therethrough from a first surface to an opposing second surface of the disc.

The first surface is configured to facilitate sharpening of a workpiece by contacting engagement of the workpiece against an abrasive layer adjacent the first surface between adjacent first and second apertures of said plurality of apertures. The first surface further induces controlled axial displacement of the workpiece away from the disc as the second aperture approaches the workpiece during disc rotation.

The first surface is preferably concave so as to extend into the disc between each adjacent pair of the apertures. Alternatively, the first surface is provided with different compressibilities to induce the controlled axial displacement of the workpiece.

DETAILED DESCRIPTION

Figure 1:
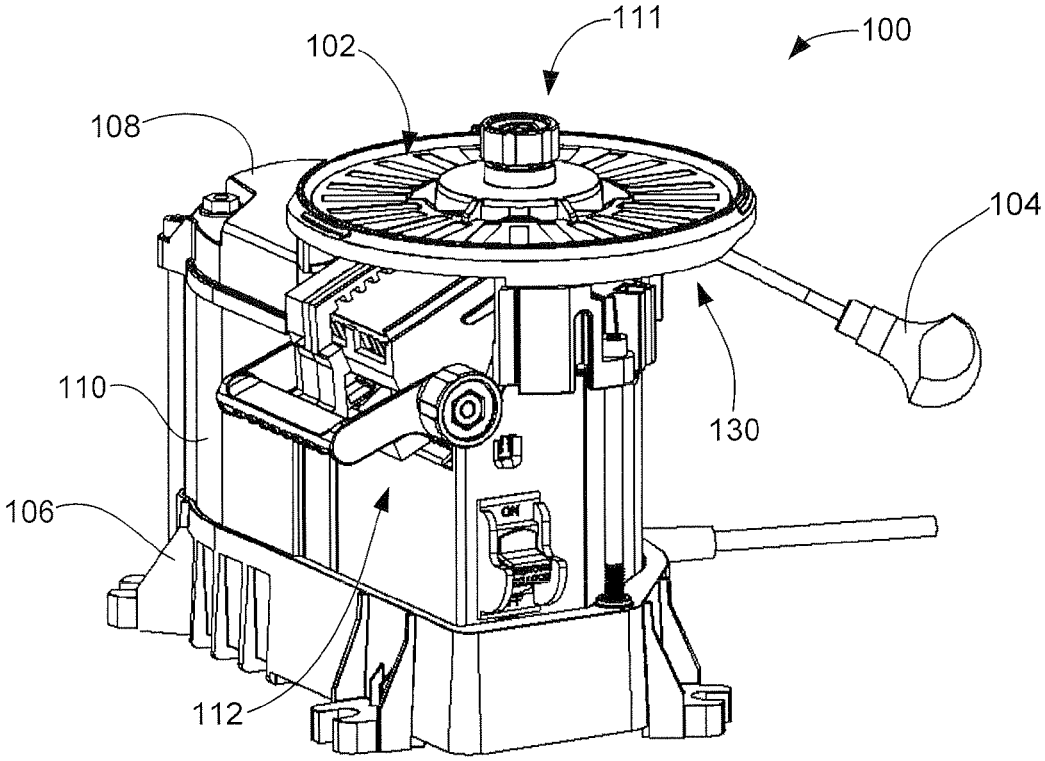
FIG. 1 shows an exemplary tool sharpener assembly that uses an abrasive disc constructed in accordance with various embodiments of the present invention.

FIG. 1 shows an exemplary tool sharpener assembly 100 to set forth an illustrative environment in which various embodiments of the present invention can be advantageously practiced.

The assembly 100 is configured to facilitate the sharpening of various types of workpieces ("tools") through the use of a slotted, abrasive disc 102 (also referred to herein as an "abrasive wheel"). The disc 102 is rotated by the assembly 100 at a selected rotational rate during operation. This allows a user to present a cutting tool, such as tool 104, against an abrasive surface of the rotating disc 102 to sharpen a cutting edge of the tool. Various features, alternatives and advantages of the disc 102 will be set forth in detail below.

The assembly 100 is shown in FIG. 1 to include a rigid housing formed from a base member 106, top member 108 and circumferentially arrayed sidewall members 110. The housing encloses a motor 111 which rotates the abrasive disc 102 at a suitable speed, such as on the order of about 580 revolutions per minute (rpm).

A first sharpening port of the assembly 100 is generally denoted at 112. The sharpening port 112, also referred to herein as a "wedge shaped port," is preferably adapted to facilitate the sharpening of various types of chisel style tools, such as a chisel 114 illustrated in FIGS. 2A-2C. It will be noted that the port 112 presents the chisel 114 against the bottom surface of the disc 102.

Figure 2A:
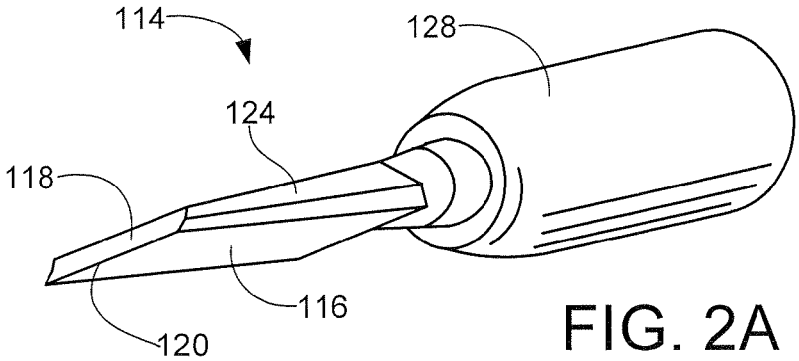
FIGS. 2A-2C provide various views of a chisel style cutting tool that can be advantageously sharpened using the abrasive disc of FIG. 1.
Figure 2B:
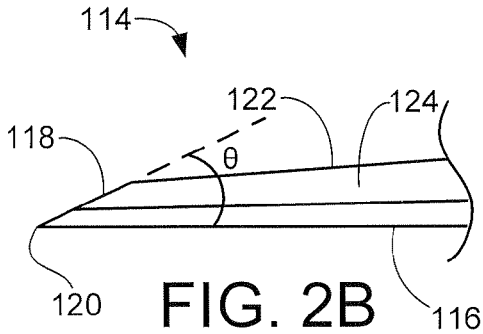
Figure 2C:
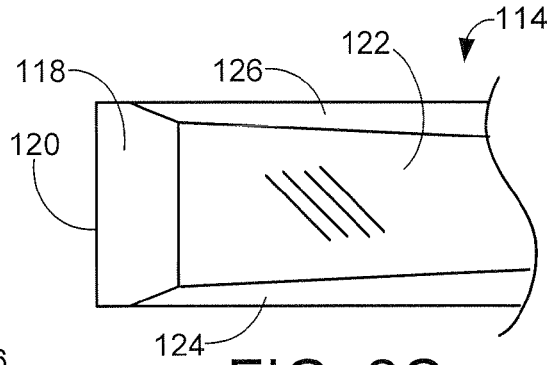

FIG. 2A provides an isometric representation of the chisel 114. The chisel 114 includes a planar back surface 116 and a beveled leading surface 118 which cooperate to form a laterally extending cutting surface (edge) 120. As further shown in FIGS. 2B-2C, the tool 114 includes an inclined top surface 122, opposing side surfaces 124, 126, and a handle 128. The back surface 116 and bevel surface 118 are disposed at an intermediary angle θ (nominally 25 degrees in the present example) to form the cutting surface 120.

The chisel 114 is preferably sharpened by presenting the chisel 114 into the first port 112 and repetitive advancing the beveled leading surface 118 into contacting abutment with the underside of the abrasive disc 102.

Referring again to FIG. 1, the assembly 100 further includes a second sharpening port 130 opposite the first port 112. The second port 130 is configured to sharpen a variety of cutting tools, such as various styles of carving tools 132 illustrated in FIG. 3. The second port 130 allows the user to manually present various workpieces such as the tools 104, 114 and 132 against the bottom surface of the abrasive disc 102 to sharpen the respective tools as desired.

Figure 3:
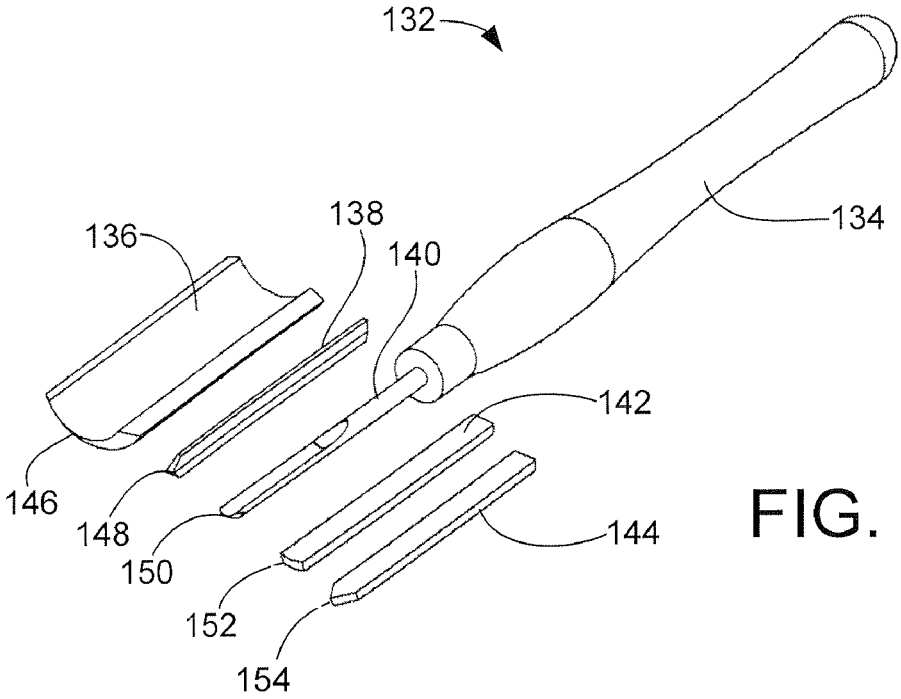
FIG. 3 shows various configurations of carving style cutting tools that can be advantageously sharpened using the abrasive disc of FIG. 1.

FIG. 3 shows the exemplary carving tools 132 to each include a handle 134 which is alternatively joined with variously configured shank portions 136, 138, 140, 142 and 144, and associated cutting edges 146, 148, 150, 152 and 154. These and other types of curvilinearly extending tools are particularly useful in the woodworking arts for carving, shaving, cutting notches, etc. in wood or other materials.

The slotted disc 102 advantageously permits the user to view the tool through the rotating disc 102 for sharpening operations carried out in either of the first and second ports 112, 130. It will be noted that various workpieces can further be presented for sharpening against the top surface as well, such as for example, to carry out a honing operation upon the back surface 116 of the chisel 114 (FIG. 2A).

Figure 4:
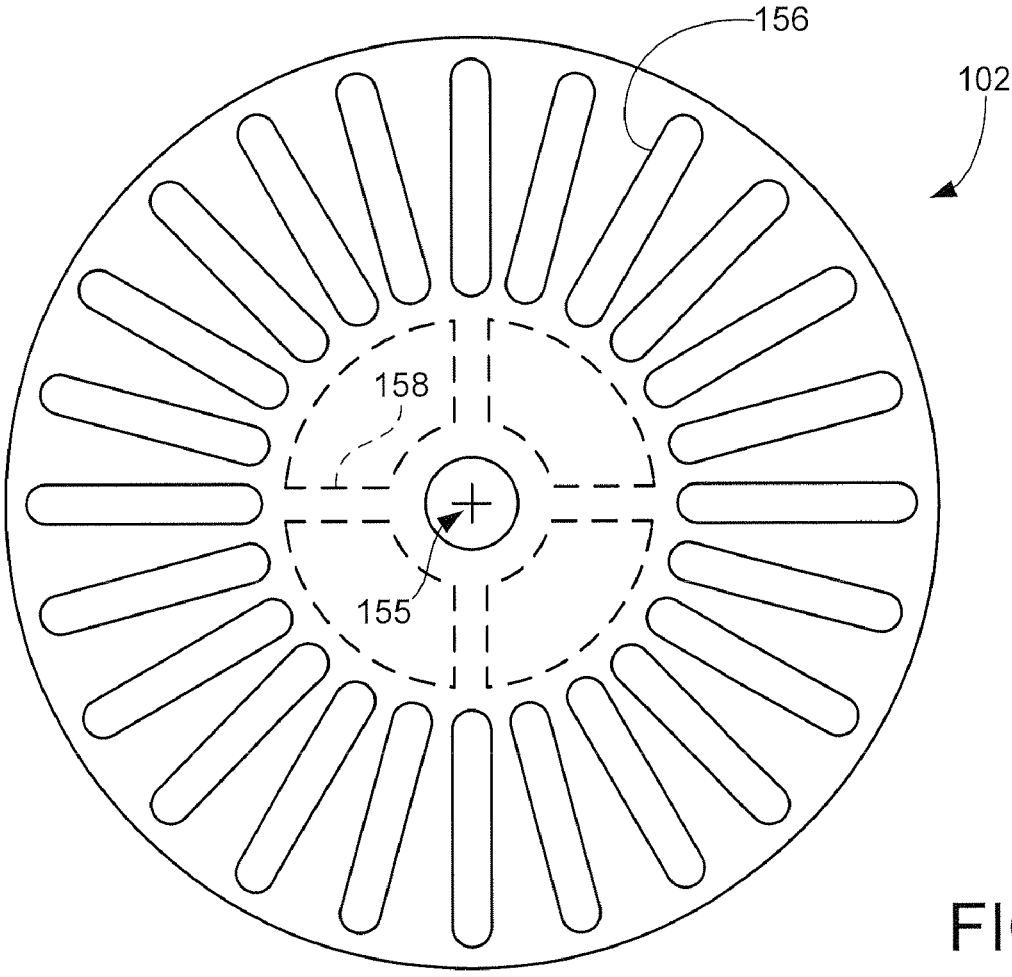
FIG. 4 is a generalized plan view representation of the abrasive disc.

FIG. 4 shows the abrasive disc 102 in accordance with various embodiments of the present invention. The disc 102 is formed from a suitable substrate material, such as but not limited to an injected molded plastic or rubber, a cast and/or machined material such as steel or aluminum, etc. Glass or carbon fiber filler may be incorporated into the substrate material, as desired.

The disc is rotatable about a central axis 155. An array of radially disposed apertures 156 extend through the disc substrate around the central axis 155, as shown. While the disc 102 in FIG. 4 has a total of twenty four (24) such spaced apart apertures, any number of apertures can be used, including apertures with different through-hole shapes and radial positions along the disc 102.

Curvilinearly extending cooling apertures, shown in broken line fashion at 158, can be optionally incorporated into the disc 102 to induce air currents that enhance airflow to provide cooling and dust remediation during sharpening. It will be appreciated that such apertures can take any number of suitable forms and configurations as desired depending on the requirements of a given application, so further details are omitted for clarity.

As mentioned above, the apertures 156 facilitate the ability of the user to observe a tool sharpening operation through the rotating disc 102. To this end, a selected tool can be sharpened by presenting the tool against one side of the disc 102 (e.g., below the disc), while the user observes the sharpening operation from a vantage point on the other side of the disc 102 (e.g., above the disc). A suitable light source (not shown) can be utilized to enhance the strobe effect induced by the high speed rotation of the disc 102, thereby further increasing visibility of the sharpening process. The disc 102, including the interior sidewalls of the apertures 156, are preferably dark in color for the same reason.

Figure 5:
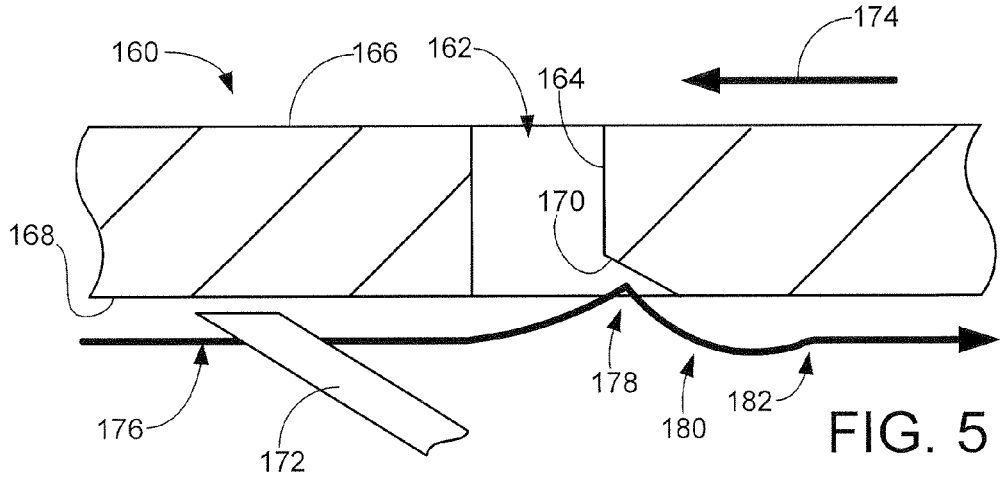
FIG. 5 Related Art
FIG. 5 shows an elevational cross-sectional representation of an abrasive disc in accordance with the related art.

To better set forth various advantages of the abrasive disc 102, FIG. 5 illustrates a different style of slotted disc 160 in accordance with the related art. The disc 160 includes a number of radially extending, spaced apart apertures, one of which is shown at 162. The apertures 162 are each formed from an interior sidewall 164 which extends from a top surface 166 to a bottom surface 168 of the disc 160. The sidewall 164 includes a chamfered landing surface 170 which extends radially as shown. It is contemplated that the bottom surface 168 constitutes an abrasive surface (not separately denoted).

During an exemplary sharpening operation upon a tool 172, disc rotation is commenced in direction 174, and the user presents the tool 172 in contacting engagement against the abrasive bottom surface 168. It is contemplated that the disc 160 is configured such that the user can observe the tool 172 during the sharpening operation through the apertures 162 from a vantage point above the rotating disc 160.

The tool 172 will generally pass along a trajectory path during the sharpening operation as indicated by 176. More specifically, the tool 172 will contactingly pass laterally along the abrasive surface 168 as the surface is rotated relative to the tool 172, until such time that the aperture 162 reaches the tool 172. At this point, the disc-ward directed pressure supplied to the tool 172 will generally cause the tool to initiate "falling" movement into and across the aperture 162, culminating in contacting engagement of the tool 172 against the landing surface 170 at contact point 178.

As a result of such contact, the tool 172 will generally deflect ("bounce") in an axial direction away from the disc 160 as indicated by segment 180 of path 176, after which the tool 172 will once again move toward the disc and come into contacting engagement against the next segment of the surface 168 at point 182. The above cycle will generally be repeated as the disc 160 continues to rotate and each of the apertures 162 is encountered in turn.

While operable, these and other disc configurations of the related art suffer a number of limitations. While landing surfaces such as 170 tend to reduce the workpiece from catching the trailing edges of the slotted apertures, the bouncing effect can reduce the effectiveness of the sharpening operation since the tool is abruptly deflected away from the disc 160 each time contact is made with the landing surfaces 170. This repetitive contact can induce undesired vibrations and noise during the sharpening process.

Generally, discs that use a single trailing edge landing surface such as 170 can only be rotated in a single direction, since the landing surface is intended to be positioned adjacent the trailing edges of the associated apertures. While discs have been provided with opposing landing surfaces to facilitate dual direction rotation, such arrangements can decrease the available surface area of the abrasive surface, as well as induce further falling of the tool toward the apertures. There are also limits to operational speeds and disc thicknesses that can be achieved with such related art discs 160.

Figure 6:
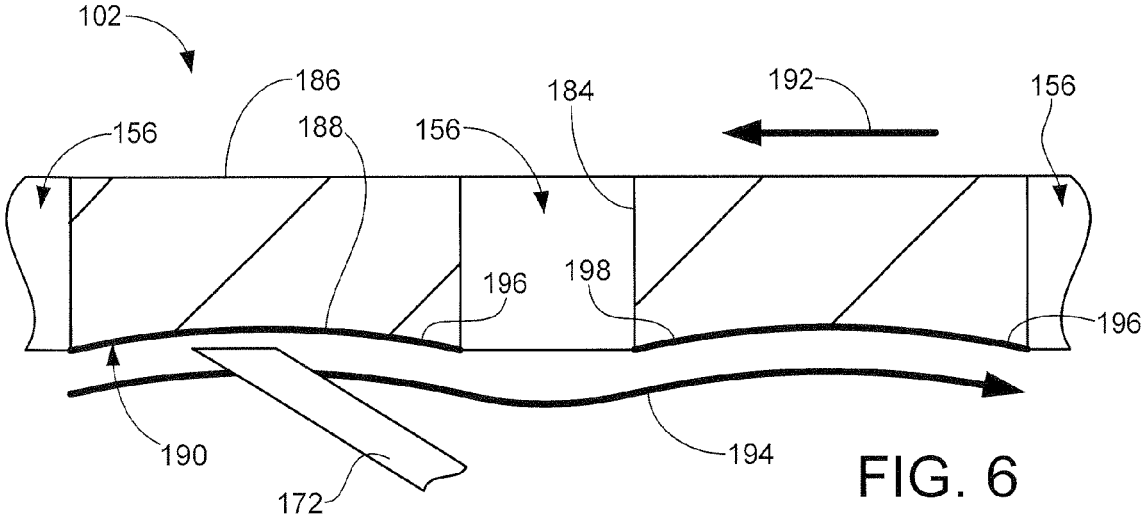
FIG. 6 provides a cross-sectional representation of the abrasive disc of FIG. 4 in accordance with some embodiments in which the disc is characterized as a single-sided abrasive disc.

Accordingly, FIG. 6 shows the abrasive disc 102 in accordance with some embodiments of the present invention. The disc 102 in FIG. 6 is shown in partial cross-section and is characterized as a single-sided abrasive disc.

The disc apertures 156 shown in FIG. 4 are formed by interior sidewalls 184 that extend through the disc substrate to adjoin upper and lower laterally extending surfaces 186, 188. The lower surface 188 of the substrate is preferably provisioned with a layer of abrasive material 190, such as sandpaper or similar abrasive having a paper or cloth substrate and adhesive backing. Alternatively, the abrasive layer can be incorporated directly into or as part of the disc material, such as via a diamond coating process.

As shown in FIG. 6, the surface 188 curvilinearly extends between each pair of adjacent apertures 156, thereby providing a concave surface therebetween along a constant radius of the disc 102. This can be characterized as providing a "launching ramp" and a "landing ramp" for the tool 172 as it crosses each aperture 156 in turn.

More specifically, during a sharpening operation the disc 102 is rotated in rotational direction 192 at a suitable velocity. The user presents the tool 172 so as to be in contacting engagement against the abrasive material 190, which curvilinearly extends adjacent the surface 188. As the tool 172 moves relative to the rotating disc 102, the tool 172 will generally take a continuously curvilinear, cyclical trajectory as generally indicated by path 194. The tool 172 will generally cycle inwardly and outwardly in relation to the corresponding contours of the surface 188, and will "jump" over each aperture 156 along the way as shown.

In this way, the disc 102 is configured to facilitate sharpening of a workpiece by contacting engagement of the workpiece against an abrasive layer (such as layer 190) adjacent a selected surface of the disc (such as surface 188) between adjacent apertures 156. The disc induces controlled axial displacement of the workpiece in a direction away from the disc as the next aperture approaches the workpiece during disc rotation, as indicated by the first half of path 194 in FIG. 6. The disc further facilitates controlled displacement of the workpiece in a direction back toward the disc and into contacting engagement with the abrasive layer via a "soft landing" at a relatively low incidence angle (such as less than about 10 degrees, and preferably less than about five degrees) once the workpiece clears the aperture, as indicated by the second half of the path 194 in FIG. 6.

The respective sizes and shapes of the apertures 156, the radial distances therebetween, the relative amounts of curvature of the respective concave portions of the surface 188, and the rotational speed of the disc 102 are mutually selected to obtain the desired trajectory characteristics for the tool. Generally, it is contemplated that the disc 102 will be configured such that a leading portion 196 of the surface 188 will induce an acceleration of the tool away from the wheel as the tool begins to cross the aperture 156.

As the tool continues to cross the aperture, the disc-ward directed applied force to the tool 172 will cause the tool to reverse course and initiate acceleration back toward the disc 102, eventually landing adjacent a trailing portion 198 of the surface 188 beyond the aperture 156. In this way, the tool 172 undergoes a controlled, repetitive motion without snagging a sidewall of the aperture 156 or an edge of the abrasive material 190, and without incurring large impact forces upon landing.

Although the leading and trailing portions 196, 198 of the surface 188 are shown to be nominally symmetric in FIG. 6, it will be appreciated that the relative elevational heights of the respective leading and trailing portions 196, 198 can be adjusted as desired to further tailor the trajectory characteristics of the workpiece. The respective elevational heights and amounts of concavity can also be varied with respect to radial position across the disc 102 to account for different observed linear velocities thereof.

Figure 7:
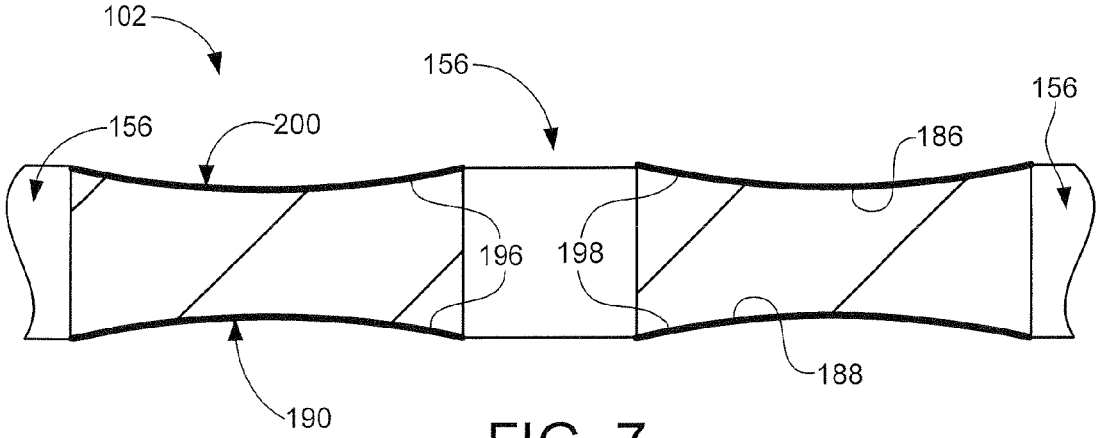
FIG. 7 provides an alternative elevational cross-sectional representation of the disc in accordance with other embodiments in which the disc is characterized as a double-sided abrasive disc.

FIG. 7 provides an alternative configuration for the abrasive disc 102, in that the disc 102 as represented in FIG. 7 is a double-sided abrasive disc. The upper surface 186 is concave to nominally match (mirror) the concave lower surface 188. A second layer of abrasive material 200 is adhered or otherwise formed on the upper surface 186, as shown.

The respective abrasives utilized on the surfaces 186, 188 can be selected to have different grit characteristics; for example, coarse material removal can be effected on one side and a finer, honing operation can be effected on the other. As will be appreciated, the apertures 156 are not necessarily used for observational purposes when the tool is sharpened on the same side as the user's vantage point, but nothing otherwise prevents the user from sharpening a workpiece on both the upper and lower sides of the disc 102. The apertures may, however, enhance particulate remediation and cooling during top side sharpening.

The use of an injection molded process to form the disc 102 advantageously facilitates the precise formation of the various surfaces and apertures without necessarily requiring secondary processing operations. The disc 102 can alternatively be formed using a suitable metal casting, molding, and/or machining operation. Greater flexibility of the disc 102 may be desired, however, such as for lower speed operations, and different materials and/or thicknesses can be utilized accordingly.

Figure 8:
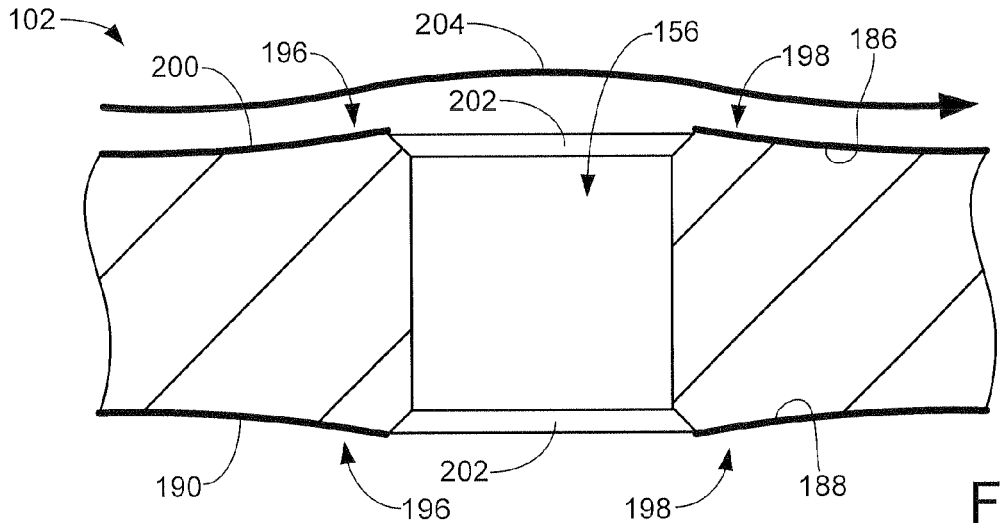
FIG. 8 sets forth yet another alternative embodiment for the abrasive disc in which chamfered surfaces are supplied adjacent the respective apertures in the disc.

FIG. 8 shows another alternative embodiment for the abrasive disc 102. The configuration of FIG. 8 is generally similar to that of FIG. 7, except that the apertures 156 are each supplied with relatively small chamfered surfaces 202.

The chamfered surfaces 202 can provide a number of benefits, including enhanced manufacturability of the disc 102 and alignment of the respective adhesive layers 190, 200. It is contemplated that the chamfered surfaces 202 form a portion of the apertures 156 and will not serve as landing zones for the tool; rather, as before the tool will take a curvilinear path (denoted at 204 in FIG. 8) and land on the trailing portions 198 of the abrasive material past the associated apertures 156.

Figure 9:
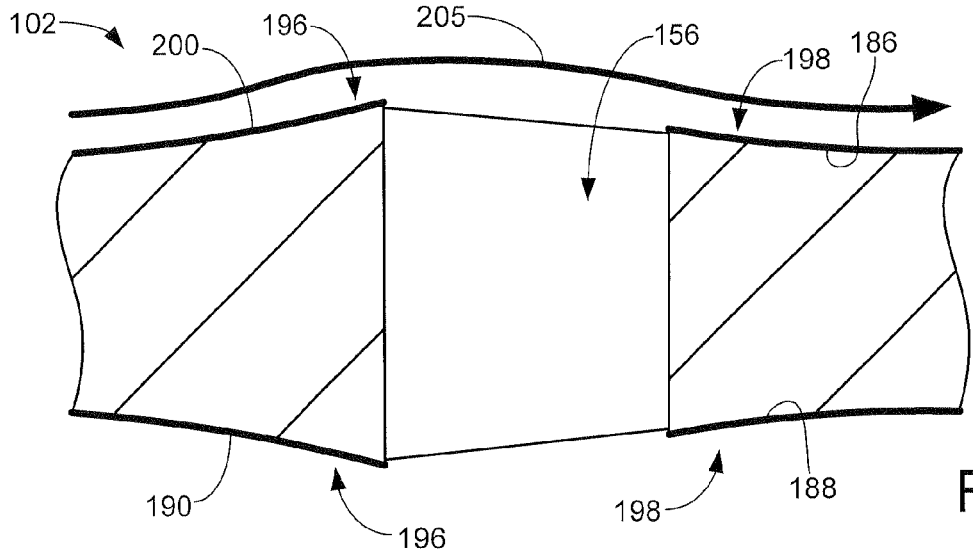
FIG. 9 sets forth still another alternative embodiment for the abrasive disc in which different elevations are provided for portions adjacent the leading and trailing edges of the respective apertures.

FIG. 9 shows another alternative embodiment for the abrasive disc 102. The disc 102 in FIG. 9 incorporates different elevations for the respective leading and trailing portions 196, 198 of the respective surfaces 186, 188, so that the disc substrate is somewhat thicker upstream of the aperture 156 as compared to downstream of the aperture 156. In this way, the launch angle of the tool as it approaches the aperture 156 is somewhat greater than the landing angle of the tool, as shown by trajectory path 205.

Figure 10:
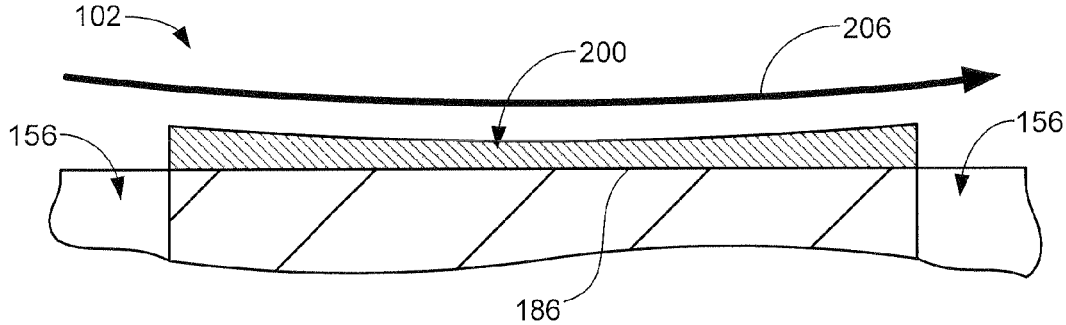
FIG. 10 is another alternative embodiment for the abrasive disc in which the disc is substantially flat and desired contours are supplied by an associated layer of abrasive material with varying thicknesses.

FIG. 10 shows another embodiment for the abrasive disc 102. In FIG. 10, a selected surface (in this case, the upper surface 186) is substantially flat, and the desired concave characteristics are supplied by differences in thickness of the abrasive layer of material 200 (such as, for example, through the use of different thicknesses of backing). As before, the tool will take a generally curvilinear path as denoted by path 206.

Figure 11:
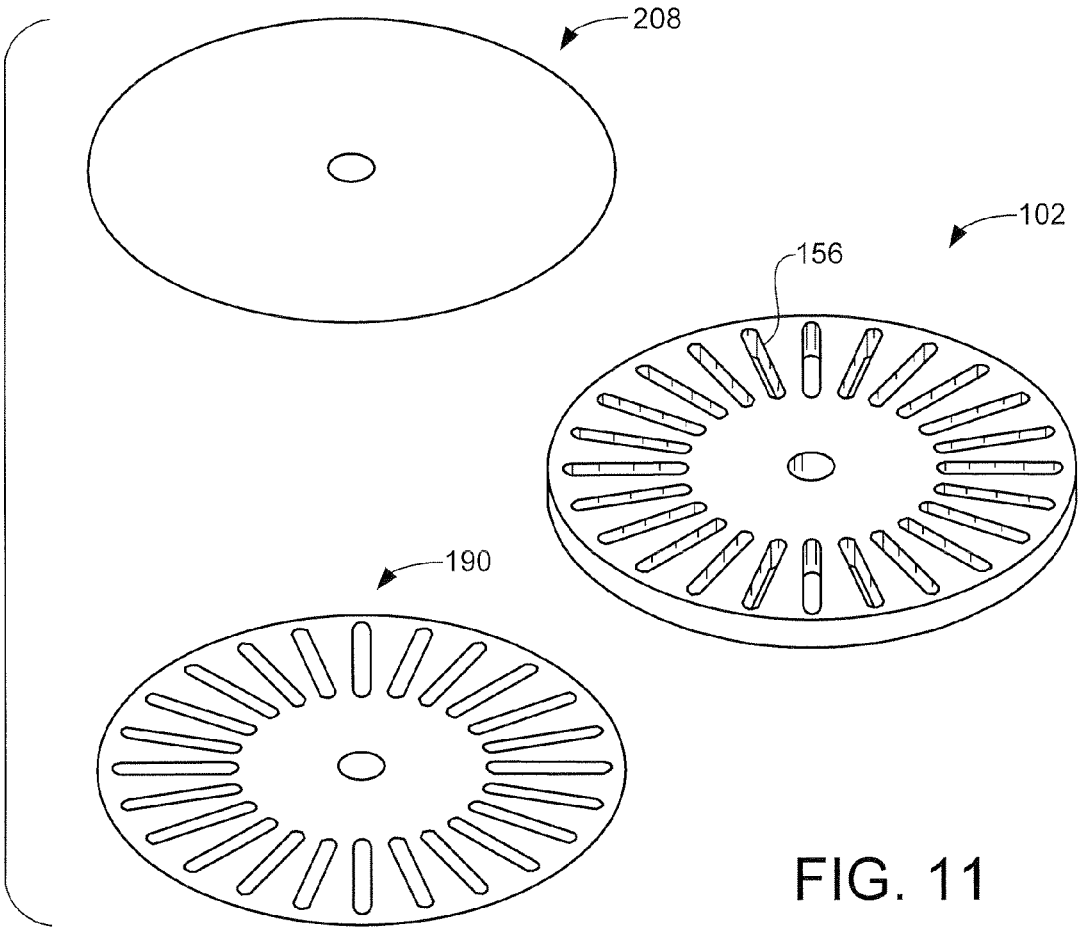
FIG. 11 shows the abrasive disc in conjunction with various exemplary abrasive layers of material that can be affixed thereto.

FIG. 11 generally illustrates the abrasive disc 102 in conjunction with a selected layer of abrasive material, in this case the aforementioned lower layer of abrasive material 190 which can be adhered to the lower surface 188 (FIGS. 6-9) of the disc 102 via a suitable adhesive that preferably forms a portion of the material 190. It will be appreciated that the upper layer of abrasive material 200 is nominally identical to the material 190 shown in FIG. 11.

Alternatively, a solid layer of abrasive material 208 can be advantageously adhered to the disc 102, as shown in FIG. 11. For reference, the material 190, 200 and 208 are sometimes more generally referred to herein as "media." While it is apparent that placement of the solid media 208 will cover up the apertures 156 thereby preventing through-disc viewing, it is contemplated that the disc 102 has sufficient strength and rigidity to support such solid layers of abrasive material during a sharpening operation. An advantage to the use of adhesive layers to affix the abrasive materials allows the application and removal of different media for different applications, as well as to replace worn media.

Figure 12:
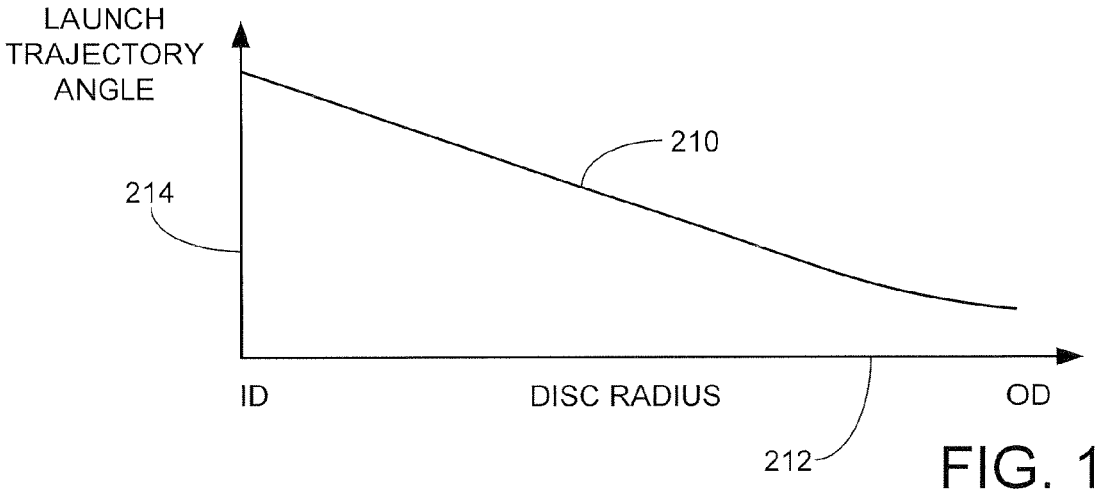
FIG. 12 graphically represents a preferred relationship between launch trajectory angle and disc radius to account for different disc linear velocities.

FIG. 12 provides a graphical representation of a trajectory curve 210 plotted against a disc radius x-axis 212 and a launch trajectory angle y-axis 214. Curve 210 serves to illustrate that the respective launch trajectories (i.e., the initial upward angle of the tool as a given aperture 156 is reached) are preferably not maintained constant across the radius of the disc 102, but rather, are configured to accommodate different linear velocities of the disc.

As will be recognized, for a constant disc rotation rate, such linear velocities are generally lower near the innermost diameter (ID) of the disc, and are generally higher near the outermost diameter (OD) of the disc. Thus, a higher initial launch angle is desired for locations nearer the ID as compared to the OD to accommodate the lower linear velocities near the ID. Alternatively, a substantially constant launch trajectory angle can be utilized across the radius of the disc 102, and the effective angular widths of the apertures 156 with respect to the disc 102 can be adjusted so as to be narrower nearer the ID and wider nearer the OD. These and other considerations can be readily accounted for by the skilled artisan in view of the present disclosure.

Figure 13:
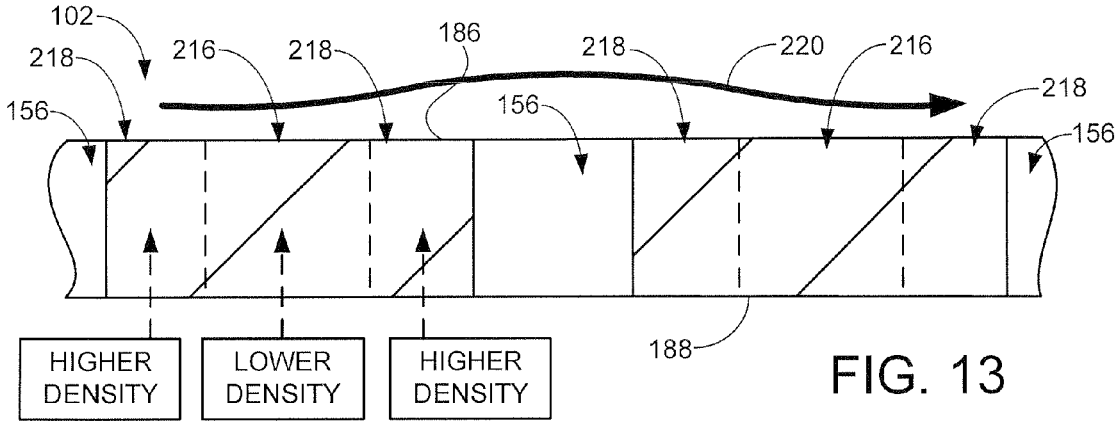
FIG. 13 shows yet another alternative for the abrasive disc in which the disc substrate is supplied with different densities to achieve the desired curvilinear path for the tool.

While embodiments presented thus far have generally incorporated the use of concave shaped upper and lower surfaces of the disc 102 and/or concaved shaped media thereon, such are not necessarily required. FIG. 13 sets forth another alternative embodiment in which the upper and lower surfaces 186, 188 of the disc 102 are substantially flat. However, the respective surfaces are provided with varying densities or surface textures to achieve the same curvilinear travel path for the tool as before.

More specifically, as shown in FIG. 13 lower density areas of the disc 102 are generally denoted at 216 and higher density areas are generally denoted at 218. The variable density areas can be formed in a number of ways, such as through the use of different localized materials, filler, foaming agents, etc. during an injection molding process. Features can also be provisioned into the molds used to injection mold the discs 102 to form open cells, lattices, or other structures that result in the intermediate areas 216 having a lower density (and thus higher compressibility) as compared to the areas 218 adjacent the apertures 156. As a result, the tool will take a curvilinear path 220 as before.

Figure 13A:
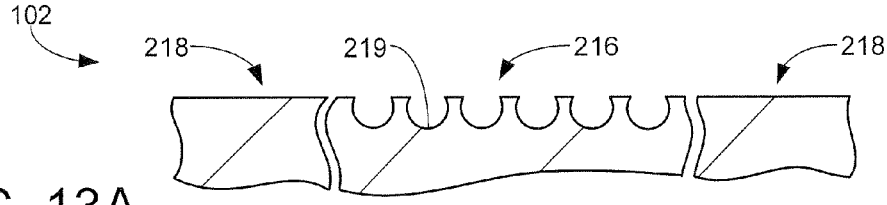
FIG. 13A provides one preferred arrangement for the disc configuration of FIG. 13.

FIG. 13A illustrates one preferred construction for the disc as set forth in FIG. 13. An array of open cells 219 are provisioned in each of the lower density (e.g., higher compressibility) regions 216 of the disc 102, thereby providing a relatively higher compressibility of the disc 102 in this area compared to the higher density portions 218.

Figure 14:
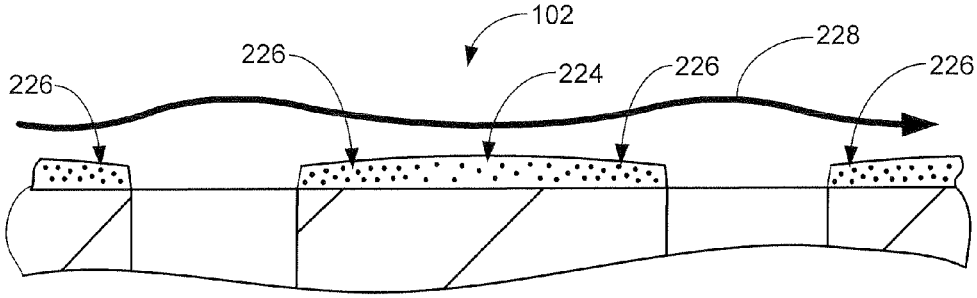
FIG. 14 illustrates another embodiment in which the desired curvilinear path is obtained by a convex surface with different densities.

FIG. 14 provides another related embodiment for the abrasive disc 102 in which a surface layer of material 222, such as but not limited to the abrasive media discussed above, is similarly provisioned with intermediary lower density regions 224 and higher density regions 226. These respective regions 224, 226 result in a curvilinear path for the tool as depicted by 228. FIG. 14 thus serves to demonstrate that the desired axial deflection can be obtained even with the use of a convex shaped surface between adjacent apertures 156.

It is contemplated that the assembly 100 of FIG. 1 is configured to facilitate manual movement of the tool by the user during the sharpening operation. That is, the user will grasp the handle portion of the tool and present it to the underside of the disc such via ports 112, 130 (FIG. 1). Alternatively, the user will grasp the handle portion of the tool and advance it across the topside of the disc 102. In each case, the user will be the primary source for the disc-wardly directed force, and will provide natural compliance for the tool during both launching and landing operations as the tool moves across each aperture 156.

Figure 15:
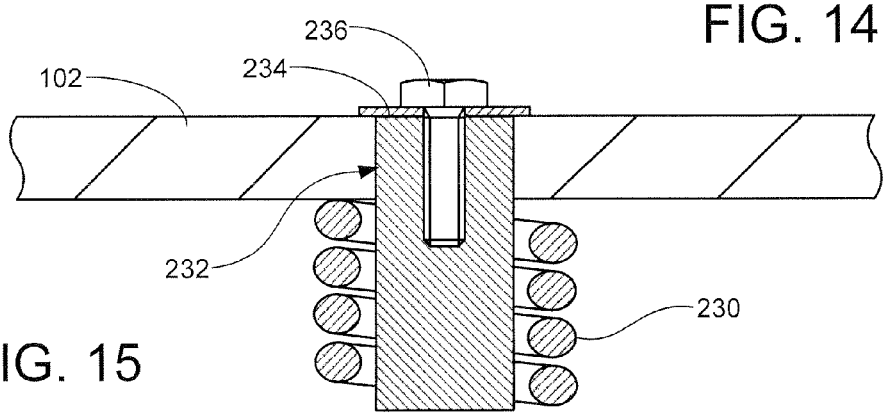
FIG. 15 shows the disc in conjunction with a compliance member characterized as a spring to provide axial compliance to the disc.

Nevertheless, the abrasive disc 102 is not so limited, but can rather be incorporated into any number of environments, including but not limited to hard fixtured or automated (e.g., robotics) systems that may not supply compliance to the tool in the same way that a user may when manually presenting the tool. Accordingly, FIG. 15 sets forth a cross-sectional representation of the abrasive disc 102 in conjunction with a biasing member 230, characterized as a spring. The disc 102 is attached to a rotor assembly 232 of the motor via washer clamp 234 and threaded fastener 236. The biasing member 230 permits a controlled amount of axial compliance of the disc 102 during a sharpening operation, thereby further facilitating the efficiency of the sharpening operation.

It will now be appreciated that the abrasive disc as embodied herein presents several advantages over the prior art. The curvilinear path taken by the tool improves the efficiencies associated with the sharpening operation by providing controlled cyclical movement of the tool without the sharp impacts, vibration, noise and other deleterious effects often encountered in prior art systems. Wider apertures can be used, which advantageously permit the use of lower operational rotational speeds, enhance through-disc visibility, and allow the use of greater thickness discs.

Various embodiments presented herein advantageously allow operation of the disc 102 in either rotational direction, which allows the disc 102 to be used on both sides by the same motor without the need to reverse the motor rotational direction or to manually flip the disc in order to utilize both abrasive layers of the disc. While discs as embodied herein can be tailored for a wide range of rotational speeds, the various embodiments presented herein further allow sharpening operations to occur at significantly lower speeds as compared to discs of the related art. Such lower speed grinding can provide a number of benefits, such as reduced heating of the tool (and resulting over temperature damage), as well as providing finer rates of material removal.

The significantly reduced incidence angle at which the workpiece comes into contact with the landing portions of the embodied abrasive disc significantly reduces the surface pressure upon the adhesive layer during landing as compared to discs of the prior art. This enables the various discs as embodied herein to use adhesive media with substantially lighter weight backing layers, and lighter weight abrasives, as compared to the prior art.

It is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed.

What is claimed is:

1. An apparatus comprising an abrasive disc rotatable about a disc rotational axis, the disc comprising a plurality of spaced apart, radially disposed apertures extending therethrough from a first surface to an opposing second surface of the disc, wherein the first surface is configured to facilitate sharpening of a workpiece by contacting engagement of the workpiece against an abrasive layer adjacent the first surface between adjacent first and second apertures of said plurality, and to induce controlled axial displacement of the workpiece away from the disc as the second aperture approaches the workpiece during disc rotation, the first surface curvilinearly extending between the first and second apertures so as to provide a concave surface therebetween that extends into the disc.

2. The apparatus of claim 1, wherein the concave surface is characterized as a first concave surface, and wherein nominally identical concave surfaces are disposed between each adjacent pair of the plurality of apertures along a selected radius of the disc.

3. The apparatus of claim 1, wherein the concave surface comprises a launching portion immediately adjacent the second aperture which induces axially directed acceleration of the workpiece away from the disc and across the second aperture, and a landing portion adjacent the first aperture which receives contacting engagement of the workpiece after the workpiece passes across the first aperture.

4. The apparatus of claim 1, wherein the apertures are configured to facilitate observation of said sharpening of the workpiece by a user through an overall thickness of the disc from a vantage point adjacent the second surface.

5. The apparatus of claim 1, wherein the second surface is nominally identical to the first surface so that the second surface is configured to facilitate sharpening of the workpiece by contacting engagement of the workpiece against a second abrasive layer adjacent the second surface between the first and second apertures, and by inducing controlled axial displacement of the workpiece away from the disc as the second aperture approaches the workpiece during disc rotation.

6. The apparatus of claim 1, wherein the abrasive layer is characterized as a removably affixable abrasive media adhered to the first surface using a layer of adhesive.

7. The apparatus of claim 1, wherein the first surface is substantially flat so as to lie substantially in a plane perpendicular to the disc rotational axis.

8. The apparatus of claim 7, wherein the abrasive layer is affixed to the substantially flat first surface and curvilinearly extends between the first and second apertures so as to provide a concave surface therebetween with respect to the first surface.

9. The apparatus of claim 1, wherein the first surface comprises a first portion adjacent the first aperture, a second portion adjacent the second aperture and an intermediate portion between the first and second portions, wherein the intermediate portion has a compressibility that is substantially greater than a compressibility of the respective first and second portions.

10. The apparatus of claim 9, wherein the intermediate portion comprises an array of open cells that provide the intermediate portion with a substantially greater compressibility as compared to the compressibility of the respective first and second portions.

11. The apparatus of claim 1 wherein the disc further comprises a layer of material affixed to the first surface, the layer of material comprising a first portion adjacent the first aperture, a second portion adjacent the second aperture and an intermediate portion between the first and second portions, wherein the intermediate portion has a compressibility that is substantially greater than a compressibility of the respective first and second portions.

12. The apparatus of claim 11, wherein the layer of material curvilinearly extends between the first and second apertures so as to provide a convex surface therebetween with respect to the first surface.

13. The apparatus of claim 1, wherein the abrasive layer further extends adjacent the first surface between the second aperture and an adjacent third aperture of said plurality so that the second aperture is between the first and third apertures, wherein the disc is further configured such that the workpiece travels in noncontacting relation to the disc as the second aperture passes adjacent the workpiece, said noncontacting relation terminating when the workpiece comes into contact with the abrasive layer between the second and third apertures at an angle of incidence of about 10 degrees or less.

14. The apparatus of claim 1, further comprising a housing which encloses a motor, wherein the motor is configured to rotate the abrasive disc.

15. An apparatus comprising:

a housing which encloses a motor; and an abrasive disc rotatable by the motor about a disc rotational axis, the disc comprising a plurality of spaced apart, radially disposed apertures extending therethrough from a first surface to an opposing second surface of the disc, wherein the first surface is configured to facilitate sharpening of a workpiece by contacting engagement of the workpiece against an abrasive layer adjacent the first surface between adjacent first and second apertures of said plurality, and to induce controlled axial displacement of the workpiece away from the disc as the second aperture approaches the workpiece during disc rotation, and wherein the second surface is nominally identical to the first surface so that the second surface is configured to facilitate sharpening of the workpiece by contacting engagement of the workpiece against a second abrasive layer adjacent the second surface between the first and second apertures, and by inducing controlled axial displacement of the workpiece away from the disc as the second aperture approaches the workpiece during disc rotation.

16. The apparatus of claim 15, wherein the first surface curvilinearly extends between the first and second apertures so as to provide a concave surface therebetween that extends into the disc.

17. The apparatus of claim 15, wherein the abrasive layer is characterized as a removably affixable abrasive media adhered to the first surface using a layer of adhesive.

18. The apparatus of claim 15, wherein the abrasive layer further extends adjacent the first surface between the second aperture and an adjacent third aperture of said plurality so that the second aperture is between the first and third apertures, wherein the disc is further configured such that the workpiece travels in noncontacting relation to the disc as the second aperture passes adjacent the workpiece, said noncontacting relation terminating when the workpiece comes into contact with the abrasive layer between the second and third apertures.

19. The apparatus of claim 18, wherein the workpiece comes into contact with the abrasive layer between the second and third apertures at an angle of incidence of about five degrees or less.

20. An apparatus comprising an abrasive disc rotatable about a disc rotational axis, the disc comprising a plurality of spaced apart, radially disposed apertures extending therethrough from a first surface to an opposing second surface of the disc, wherein the first surface is configured to facilitate sharpening of a workpiece by contacting engagement of the workpiece against an abrasive layer adjacent the first surface between adjacent first and second apertures of said plurality, and to induce controlled axial displacement of the workpiece away from the disc as the second aperture approaches the workpiece during disc rotation, wherein the first surface comprises a first portion adjacent the first aperture, a second portion adjacent the second aperture and an intermediate portion between the first and second portions, wherein the intermediate portion has a compressibility that is substantially greater than a compressibility of the respective first and second portions.

21. The apparatus of claim 20, wherein the intermediate portion comprises an array of open cells that provide the intermediate portion with a substantially greater compressibility as compared to the compressibility of the respective first and second portions.

22. The apparatus of claim 20, wherein the disc further comprises a substrate through which the first and second apertures extend and a layer of compressible material affixed to the substrate between the first and second apertures to form the intermediate portion.

23. The apparatus of claim 20, wherein the intermediate portion curvilinearly extends between the first and second apertures so as to provide a convex surface therebetween with respect the first surface.

* * * * *